US010843146B2

(12) United States Patent
Seifferth

(10) Patent No.: US 10,843,146 B2
(45) Date of Patent: Nov. 24, 2020

(54) LABORATORY APPARATUS

(71) Applicant: Hans Heidolph GmbH, Kelheim (DE)

(72) Inventor: Dirk Seifferth, Fürth (DE)

(73) Assignee: Hans Heidolph GmbH, Kelheim (DE)

( * ) Notice: Subject to any disclaimer, the term of this patent is extended or adjusted under 35 U.S.C. 154(b) by 288 days.

(21) Appl. No.: 15/768,919

(22) PCT Filed: Oct. 18, 2016

(86) PCT No.: PCT/EP2016/074986
§ 371 (c)(1),
(2) Date: Apr. 17, 2018

(87) PCT Pub. No.: WO2017/067932
PCT Pub. Date: Apr. 27, 2017

(65) Prior Publication Data

US 2019/0076803 A1 Mar. 14, 2019

(30) Foreign Application Priority Data

Oct. 19, 2015 (DE) ..... 10 2015 117 761

(51) Int. Cl.
*B01F 11/00* (2006.01)
*B01F 13/08* (2006.01)

(52) U.S. Cl.
CPC ..... *B01F 11/0028* (2013.01); *B01F 13/08* (2013.01); *B01F 2215/0037* (2013.01)

(58) Field of Classification Search
CPC .. B01F 11/0028; B01F 13/08; B01F 13/0809; B01F 2215/0037
See application file for complete search history.

(56) References Cited

U.S. PATENT DOCUMENTS 5,259,672 A * 11/1993 Rowe ..... B01F 11/0034 335/219
5,511,879 A * 4/1996 Fletcher ..... B01F 11/0014 366/208
2006/0193198 A1* 8/2006 Bae ..... B01F 11/0014 366/111

FOREIGN PATENT DOCUMENTS

| | | | |
|---|---|---|---|
| DE | 924541 | C | 3/1955 |
| EP | 1721964 | A1 | 11/2006 |
| SU | 1205932 | A1 | 1/1986 |
| WO | 9110503 | A1 | 7/1991 |

* cited by examiner

*Primary Examiner* — Anshu Bhatia
(74) *Attorney, Agent, or Firm* — Wiggin and Dana LLP; Gregory S. Rosenblatt; Rikesh P. Patel

(57) ABSTRACT

A laboratory device, in particular for shaking and/or mixing substances, comprises a base unit, that comprises a drive apparatus, and a pivot unit, that is pivotably connected to the base unit by means of a bearing element about axes oriented perpendicular to a central axis of the base unit. The drive apparatus comprises an arrangement of magnetic elements at an inner side of a roll-off surface of the base unit and a control apparatus that is configured to control the arrangement of magnetic elements for generating a peripheral magnetic field along a closed path at an outer side of the roll-off surface to drive the roll-off section of the pivot unit by means of magnetic attraction and/or repulsion to make a rolling-off along said path.

15 Claims, 4 Drawing Sheets

LABORATORY APPARATUS

FIELD OF THE DISCLOSURE

The present invention relates to a laboratory device, in particular for shaking and/or mixing substances, having a base unit that comprises a drive apparatus.

BACKGROUND

Laboratory devices are devices specifically designed for use in a laboratory, in particular in an least also chemical or biochemical laboratory. Such laboratory devices can be provided to carry out movements, for instance to mix substances by means of these movements. The movements in this respect typically run periodically and in particular comprise changes of direction. Substances are in particular mixed on the basis of swirling or shifting by such a shaking thereof.

Different movement routines can be advantageous in this respect in dependence on the application. Laboratory devices can, for example, carry out a linearly oscillating ("to and fro") movement, a rotational movement in which the respective substances are rotated about an axis of rotation, a translation movement oscillating in a circular or oval motion in which the respective substances admittedly do not rotate, but are moved on a circular or oval path, or a rocking movement in which the respective substances are alternately tilted in opposite directions. The movement can in particular also be a tumbling movement. On a tumbling movement, the respective substances are pivoted with respect to a central axis of the tumbling movement, with the radial alignment of the pivoting periodically rotating about the central axis. Since only the alignment of the pivoting changes here, the tumbling movement is not a rotational movement.

To generate a tumbling movement, the laboratory device can comprise a pivot unit that is pivotably connected to the base unit by means of a bearing element about axes oriented perpendicular to a central axis of the base unit of the laboratory device. Substances to be mixed can then be arranged at the pivot unit that can be driven by the drive apparatus of the base unit to make a tumbling movement about the central axis. "Central axis" is here not to be understood such that it would necessarily have to extend in any way centrally through the base unit. Since it, however, represents the center of the tumbling movement, it is at least expedient if it extends through a central region of the base unit.

Since the bearing element enables a pivoting of the pivot unit about axes oriented perpendicular to the central axis, the pivot unit can be pivoted in any desired radial alignment with respect to the central axis. The radial direction of the pivoting running about the central axis can then be changed by means of the drive apparatus to generate the tumbling movement. Since the pivot unit, however, does not rotate about the central axis, the pivot unit does not carry out any rotation during the tumbling movement. It is, however, generally conceivable that the tumbling movement additionally has a rotational movement or also another movement routine superposed.

To drive the pivot unit by means of the drive apparatus to make the tumbling movement, the pivot unit can be mechanically coupled to the drive apparatus. Joining rods can be provided, for example, that engage eccentrically to the central axis at the pivot unit to periodically pivot the pivot unit up and down at a respective engagement point. The tumbling movement can then be generated by means of at least two joining rods that engage at different engagement points and that pivot periodically offset in time with respect to one another. Such drives are, however, complex and/or expensive in construction. Since the pivot unit is not only connected to the base unit via the bearing element with such a drive, but also via the joining rods, the replacement of the pivot unit is additionally made more difficult with such a design.

Laboratory devices are also known in which an intermixing of a sample of substances is not achieved in that the sample is driven to make a movement progression in space, but rather in that an intermixing movement is stimulated within the sample, for example in that a magnetic bar (magnetic stir bar) introduced into the sample is magnetically driven to make a rotational movement by the drive apparatus of the base unit of the laboratory device. Known laboratory devices formed as magnetic stirrers, however, do not have any means to also intermix a sample, alternatively to the intermixing by means of the magnetic stir bar, by means of a spatial movement progression, for instance a tumbling movement. To retrofit such a magnetic stirrer for the generation of an alternative or additional work movement, for example by attachment of a pivot unit operated by means of joining bars or of another work unit driven by means of a mechanical transfer to the magnetic stirrer, a separate further drive apparatus would be necessary to drive the work unit.

It is therefore an object of the invention to provide a laboratory device, in particular for shaking and/or mixing substances, that can be used particularly flexibly with a small construction complexity.

SUMMARY

The object is satisfied by a laboratory device having the features of claim 1 and in particular in that the drive apparatus comprises an arrangement of magnetic elements at an inner side of a roll-off surface of the base unit and a control apparatus and in that the pivot unit has a peripheral, in particular magnetic, roll-off section, with the control unit being configured to control the arrangement of magnetic elements for generating a magnetic field running around a closed path at the outer side of the roll-off surface to drive the roll-off section of the pivot unit by means of magnetic attraction and/or repulsion to make a rolling off along said path.

The laboratory device therefore has a pivot unit that is not mechanically driven, but rather magnetically. A moving magnetic field is generated by means of magnetic elements within the base unit for this purpose. This magnetic field extends through a roll-off surface on whose one side (inner side) the magnetic elements are arranged. The pivot unit connected to the base unit by means of the bearing element is located on the other side (outer side) of the roll-off surface. The roll-off surface, that is preferably horizontally oriented, can be formed, for example, at a wall element of the laboratory device. "Inner side" and "outer side" can in this case mean an arrangement inside and outside the laboratory device respectively. These terms are, however, only used for a general linguistic distinction of the two sides of the roll-off surface independently of a definition of an inner space and of an outer space of any body. So that the magnetic field can engage at the pivot unit to effect its tumbling movement, the peripheral roll-off section is provided at the pivot unit and in particular comprises a material with good magnetic properties. It is important here that said magnetic field can exert a force on the roll-off section to move the pivot unit. The material is preferably ferromagnetic, but can generally also be ferrimagnetic, paramagnetic, or diamagnetic. The material is preferably a soft magnetic material having negligible or only small hysteresis so that essentially only that region of the roll-off section is respectively magnetized that is just cooperating with the magnetic field.

At the outer side, that is on the side facing the pivot unit, of the roll-off surface, the magnetic field moves along a closed path. This means that a region of high magnetic field density that is suitable to attract a respective region of the roll-off section runs around said path. In this respect, a plurality of magnetic pols can generally also simultaneously run around, for example a magnetic north pole and a magnetic south pole that are each located at opposite points of the closed path. A peripheral pole that attracts the roll-off section is preferably provided. In this respect a peripherally changing region of the roll-off section is in particular attracted.

A path is to be considered closed here whose start and end coincide so that it is periodically run through again and again with a continued progression. It should, however, not be precluded by the designation as "closed" that the path is also at least sectionally run through erratically or discontinuously in a different manner, which can be considered as an interruption of the path. The closed path is not necessarily a circular path. In general, any desired progressions are conceivable by which the central axis of the base unit is run around. The progression of the path along which the peripheral magnetic field extends and the progression of the roll-off section at the pivot unit are preferably coordinated with one another and substantially correspond to one another geometrically.

The roll-off section of the pivot unit can be attracted toward the roll-off surface of the base unit by the peripheral magnetic field of the base unit. Depending on where the peripheral magnetic field, in particular an attractive pole of the peripheral magnetic field, is respectively located, the pivot unit is pivoted in the direction of this pole by the magnetic attraction acting on the roll-off section. The movement of the peripheral field along the closed path thus produces a continuous change of the radial direction of the pivoting with respect to the central axis. The peripheral magnetic field has the consequence that a respective other region of the roll-off section of the pivot unit is attracted to the roll-off surface of the base unit and comes into contact with the roll-off surface. This has the consequence that the roll-off section rolls of continuously at the roll-of surface, with a certain slip being able to occur, however. The same generally also applies accordingly when the peripheral magnetic field acts as a repulsive force.

Using such a magnetic drive for generating a tumbling movement of the pivot unit has the advantage that it can be implemented particularly simply from a construction aspect and in particular does not require any joining bars or other mechanical arrangements for transmitting the drive to the pivot unit. The pivot unit can in particular be connected to the base unit solely by the bearing element. This makes possible a particularly suitable release of the pivot unit from the base unit, for example to clean the pivot unit or to replace it with another pivot unit or with another work unit of the laboratory device. The bearing element can here in particular also be releasable from the base unit so that the base unit can also be used as a magnetic stirrer alternatively to the use as a drive for a tumbling movement. The laboratory device in accordance with the invention can thus be handled particularly flexibly and can be used for different purposes.

The pivot unit can be blocked against rotation about the central axis. This can in particular be useful if the pivot unit were also driven with a correspondingly free support in superposition on the tumbling movement to make an at least rudimentary rotational movement, which is, however, unwanted, due to the magnetic attraction or repulsion of the roll-off section by the peripheral magnetic field and/or due to the rolling off of the roll-off section at the roll-of surface. To prevent the rotation, the bearing element can in particular be configured such that it generally does not permit any rotation of the pivot unit about the central axis or about an axis in parallel therewith, but only about axes that are perpendicular thereto. The pivot unit then therefore has only two degrees of freedom, with a rotation about the central axis being blocked.

The peripheral magnetic field can be generated, for example, in that one or more permanent magnets are driven by a motor of the drive apparatus to make a movement that defines the closed path along which the magnetic field runs around. Said magnetic elements can here then be formed, for example, by the poles of the one or more permanent magnets. The motor drive having a rotating magnet known per se from a magnetic stirrer would therefore in particular also likewise be suitable for generating such a tumbling movement. In accordance with a preferred embodiment, the magnetic elements of said arrangement are, however, configured as controllable electromagnets, for example in the form of magnetic coils. The magnetic field of such electromagnets can be changed in a particularly simple manner, in particular electronically. Almost any desired progressions for the peripheral magnetic field can be implemented in this manner by a suitable spatial arrangement and by a mutually coordinated response of the respective magnetic fields.

In an advantageous embodiment, the arrangement of magnetic elements comprises at least three magnetic elements, in particular at least four, and at most eight, magnetic elements, with the magnetic elements preferably being arranged along a circular path and/or equidistant from one another. The more magnetic elements that are provided, the better a continuous transition can be implemented from one magnetic element to the next on running around the magnetic field. To generate a peripheral magnetic field, it is expedient to use at least three magnetic fields to be able to clearly fix the direction of revolution. With respect to typical dimensions of a laboratory device for shaking and/or mixing substances, arrangements of four to eight magnetic elements have proved to be particularly advantageous with respect to a continuously peripheral magnetic field, on the one hand, and with respect to the available construction space and the construction complexity, on the other hand. The closed path along which the magnetic field extends can be covered the most uniformly by an equidistant arrangement of the magnetic elements. In this case, in particular the control of the different magnetic elements can have the same temporal schedule with the exception of a respective time offset between successive magnetic elements.

A particularly simple and at the same time particularly suitable arrangement of the magnetic field elements for the generation of a uniform tumbling movement is an arrangement along a circular path. The peripheral magnetic field then extends at the outer side of the roll-off surface substantially likewise along a circular path. It is in particular further advantageous with such an embodiment if the roll-off section is formed as circular. The roll-off section can, for example, be formed as a peripheral margin or as a peripheral edge of a circular disk. This disk can then be inclined with respect to the roll-off surface such that a respective point of the margin or of the edge of the disk contacts the roll-off surface. During the tumbling movement, the margin or the edge of the disk then rolls off along a circular path on the roll-off surface.

It is furthermore above all advantageous for generating a uniform tumbling movement if the control apparatus is configured to control the arrangement of magnetic elements to generate a uniformly peripheral magnetic field. If the peripheral magnetic field is generated by an arrangement of magnetic elements of a specific number, there are regions along the progression of the peripheral magnetic field that are mainly influenced by an individual magnetic element and regions between two consecutive magnetic elements in which the magnetic field is substantially determined by the cooperation of the two magnetic elements. To avoid the intensity of the magnetic field (and thus the magnetic force acting on the roll-off section) from fluctuating or even changing erratically in the course of the peripheral magnetic field, the control apparatus can, for example, attenuate the magnetic field of the first magnetic element on the transition from a first magnetic element to a following second magnetic element and, adapted thereto, simultaneously amplify the magnetic field of the second magnetic element. The adaptation can in particular take place such that the respective resulting magnetic force on the roll-off section of the pivot unit remains substantially constant.

Alternatively to this, it is, however, also conceivable to use certain discontinuities and/or irregularities of the peripheral magnetic field directly for the generation of specific movement routines. For example, the tumbling movement can thereby have an additional stuttering movement superposed, for instance in that the magnetic elements are simply sequentially switched on or off without regulated transitions. The attraction or repulsion of the roll-off section would thereby erratically change from one magnetic element to the next so that the tumbling movement would take place step-wise with steps of different fineness or roughness depending on the speed of the magnetic elements. Such a stuttering movement can be useful for achieving special mixing effects. A special case of a tumbling movement taking place erratically is represented by a movement routine in which the pivot unit is alternately pivoted in a radial orientation and in the radial orientation diametrically opposed thereto with respect to the central axis. Such a rocking movement can in particular be caused by a drive apparatus having only two magnetic elements arranged diametrically opposed with respect to the central axis. The drive apparatus can, however, also comprise more magnetic elements.

The control apparatus is preferably configured to control microsteps. The magnetic elements of the arrangement can thereby be controlled in such a controlled manner that a magnetic field can be produced at a plurality of defined points between two consecutive magnetic elements. A large number of intermediate positions of the peripheral magnetic field can therefore be controlled with high resolution between two consecutive magnetic elements by means of a microstep control. Such a control thus reduces the required number of magnetic elements, in particular with respect to the generation of a uniformly peripheral magnetic field. The microstep control can be implemented, for example, by means of one or more integrated circuits that the drive apparatus can comprise.

In accordance with a further development, the base unit is bounded in the direction toward the pivot unit by a wall element at which an attachment element is arranged that projects in the direction toward the pivot unit with respect to the wall element, with the roll-off surface being formed at the attachment element. The wall elements can, for example, be formed as a surface bounding the base unit upwardly and can, for instance, be a part of a housing of the base unit. The attachment element can at least substantially be formed in the manner of a cylinder jacket as an attachment on said surface of the wall element. The wall element and the attachment element can here be formed in one part or be at least rigidly connected to one another. Provision can, however, also be made that the wall element and the attachment element are different parts and that the attachment element is arranged loosely or at least releasably at the wall element.

The roll-off surface generally represent that region of the base unit of the laboratory device at which the peripheral magnetic field runs around and at which the roll-off section rolls off in ongoing operation. The roll-off surface can here be provided directly at said wall element of the base unit. However, the roll-off surface does not necessarily have to be defined with respect to an arrangement in a common plane with the wall element. It can rather be advantageous with respect to a larger construction flexibility if the roll-off surface is offset with respect to the wall element, in particular projects in the direction toward the pivot unit. For this purpose, in addition to the wall element that is formed, for instance as a plate, an attachment plate can be provided which is arranged thereat and at which the roll-off surface is then formed. In this manner, the roll-of surface can be formed independently of the remaining base unit from a construction aspect and can be flexibly positioned relative to the remaining base unit. In addition, a roll-off surface projecting from the wall element can in particular be useful for achieving large inclination angles of the pivot unit since it can be avoided by the projection that the pivot unit abuts the wall element or other elements of the base unit.

In a further advantageous embodiment, the pivot element comprises a reception section for receiving substances and a base portion that projects in the direction toward the base unit with respect to the receiving section and comprises the roll-off section. This embodiment has similar advantages to the aforesaid embodiment. The roll-off section can in particular be formed largely independently of the design of the reception section due to its formation at a base portion. In embodiments having a circular roll-off section, the base portion of the pivot unit can, for example, be configured as a collar of cylinder jacket form at whose front edge the roll-off section is formed. The base portion can here be configured substantially independently of the reception section with respect to a tumbling movement to be achieved with respect to its dimensions, for instance the radius and/or the height. Conversely, the formation of the reception section does not need to take place with respect to the tumbling movement to be achieved. With a peripheral magnetic field of circular form, for example, the reception section can thus nevertheless have a different shape of generally any desired form, for instance rectangular, since it is sufficient for the generation of the tumbling movement to form the roll-off section at the base portion to match the peripheral magnetic field. In this respect, the reception section and the base portion can be formed in one part or at least rigidly connected to one another. Provision can, however, also be made that the reception section and the base portion are different parts and the base portion is formed loosely or at least releasably from the reception section.

The two aforesaid embodiments can in particular also be present in combined form. In this respect, the roll-of surface is then formed at the attachment element of the base unit and offset with respect to the wall element and the roll-off section is formed at the base portion of the pivot unit and is offset with respect to the reception section. The formation of the roll-off surface and the roll-off section whose cooperation substantially defines the tumbling movement is thereby largely decoupled in a construction aspect from the design of the remaining base unit or pivot unit.

It is furthermore possible to design laboratory devices in accordance with the invention such that individual parameters or a plurality of parameters of the tumbling movement such as an angle of inclination, are settable at least within certain ranges. For example, in an advantageous embodiment, the laboratory device can be configured such that a spacing between the pivot unit and the base unit can be variably fixed. The spacing can here in particular be defined by the bearing element or by the central axis. For example, the spacing can correspond to the spacing between a coupling point of the bearing element with the pivot unit and a coupling point of the bearing element with the base unit. An alternative definition can comprise the spacing between the pivot unit and the base unit having to be determined along the central axis.

If the spacing between the pivot unit and the base unit is unchangeable, the tumbling movement can hereby be limited to a specific inclination of the pivot unit with respect to the base unit, namely to that inclination that respectively results when the pivot unit is pivoted in a respective direction until the roll-off section contacts the roll-off surface. If in contrast the spacing is changeable, in particular that angle of inclination of the pivot unit can be set variably in this manner on the tumbling movement. A simple construction implementation of such an embodiment comprises forming the bearing element as fixable relative to the central axis in different axial positions, for instance by means of a screw thread. The variability of the spacing can, however, also be implemented in a different manner, for example by the provision of extension elements of the bearing element to be inserted or to be removed as required.

It is furthermore advantageous if the roll-off surface of the base unit and/or the roll-off section of the pivot unit are formed as changeable or exchangeable. For this purpose, an attachment element of said wall element comprising the roll-off surface and/or said base portion of the pivot unit can in particular be formed as changeable or exchangeable. Alternatively or additionally to a change of the spacing of the pivot unit from the base unit, a modification of the tumbling movement, for example with respect to a respective angle of inclination, can also be achieved by such a replaceability and/or changeability of the roll-off surface and/or of the roll-off section. In addition, wear in these regions can be compensated by a replaceability of the roll-off surface and/or of the roll-off section. Since in particular when the drive apparatus has static electromagnets and no motor or other moving parts, the greatest wear is to be expected at the roll-off surface and at the roll-off section that roll off one another as a rule with slip during the tumbling movement. If the roll-off surface of the base unit and/or the roll-off section of the pivot unit are exchangeable, the service life of the laboratory device can thereby be increased.

The object is additionally satisfied by a laboratory device in which the drive apparatus comprises an arrangement of magnetic elements at the inner side of a wall element of the base unit outwardly bounding the base unit and a control apparatus, with the control apparatus being formed to control the arrangement of magnetic elements to generate a magnetic field running around along a closed path at the outer side of the wall element, with the laboratory device comprising a bearing element or a receiver for a bearing element for connecting a work unit to the base unit by means of the bearing element to drive the work unit to make a working movement by means of the peripheral magnetic field of the drive apparatus.

This laboratory device can generally be configured in the manner of a magnetic stirrer having a peripheral magnetic field as a drive. The laboratory device in accordance with the invention can therefore also have such a magnetic stirring function, but does not have to do so. It is, however, material to such a laboratory device in accordance with the invention that the laboratory device is configured to drive a respective work unit connectable to the base unit of the laboratory device to make a working movement by means of the magnetic drive apparatus. For this purpose, the laboratory device has a bearing element or at least one receiver for a bearing element by means of which the work unit can be connected to the base unit, and indeed in a manner such that the working movement of the work unit relative to the base unit is made possible.

The work unit can in particular be a pivot unit such as described above that can be driven to make a tumbling movement by means of the drive apparatus and in particular by means of the peripheral magnetic field generated by the drive apparatus. In general, however, other work units can also be provided that, driven by the peripheral magnetic field of the drive apparatus, can carry out other types of working movements, for example, translation movements, pivot movements or tilt movements oscillating in a linear, circular, or oval manner. It can be sufficient for the drive of a rocking movement here, for instance, if the drive apparatus only comprises two magnetic elements.

The laboratory device can advantageously be configured such that different work units can be connected to the base unit of the laboratory device by means of the bearing element or of a respective bearing element received in the receiver and optionally specific to a respective work unit to be able to use the same base unit for driving different work units or different working movements. Such a laboratory device can thus be used in a particularly versatile manner.

The invention also in particular relates to a system that comprises a laboratory device such as described above and a set of at least two work units that are formed for a connection to the base unit of the laboratory device by means of a respective bearing element to be driven to make a respective working movement by the driving apparatus. In this respect, a respective different bearing element can be provided for each work unit. A respective bearing element can, however, also be suitable to connect different work units of said set to the base unit.

With respect to a laboratory device having a non-magnetic drive, in particular having a purely mechanical drive, said laboratory device and said system have the advantage of being able to have a substantially wear-free drive apparatus. In addition the magnetic drive makes it possible that it is possible to dispense with a mechanism for the force transmission from the drive apparatus to a respective work unit (such as the described pivot unit, for instance) of the laboratory device to be driven so that the work element is only mechanically connected to the base unit via the bearing element and is otherwise only magnetically coupled to the base unit. This has the advantage, for example, that such a work unit can be particularly easily released from the base unit, for instance for a cleaning, a servicing, or a functional change.

BRIEF DESCRIPTION OF THE DRAWINGS

The invention will be described in more detail in the following only by way of example with reference to the drawings.

DETAILED DESCRIPTION

Figure 1:
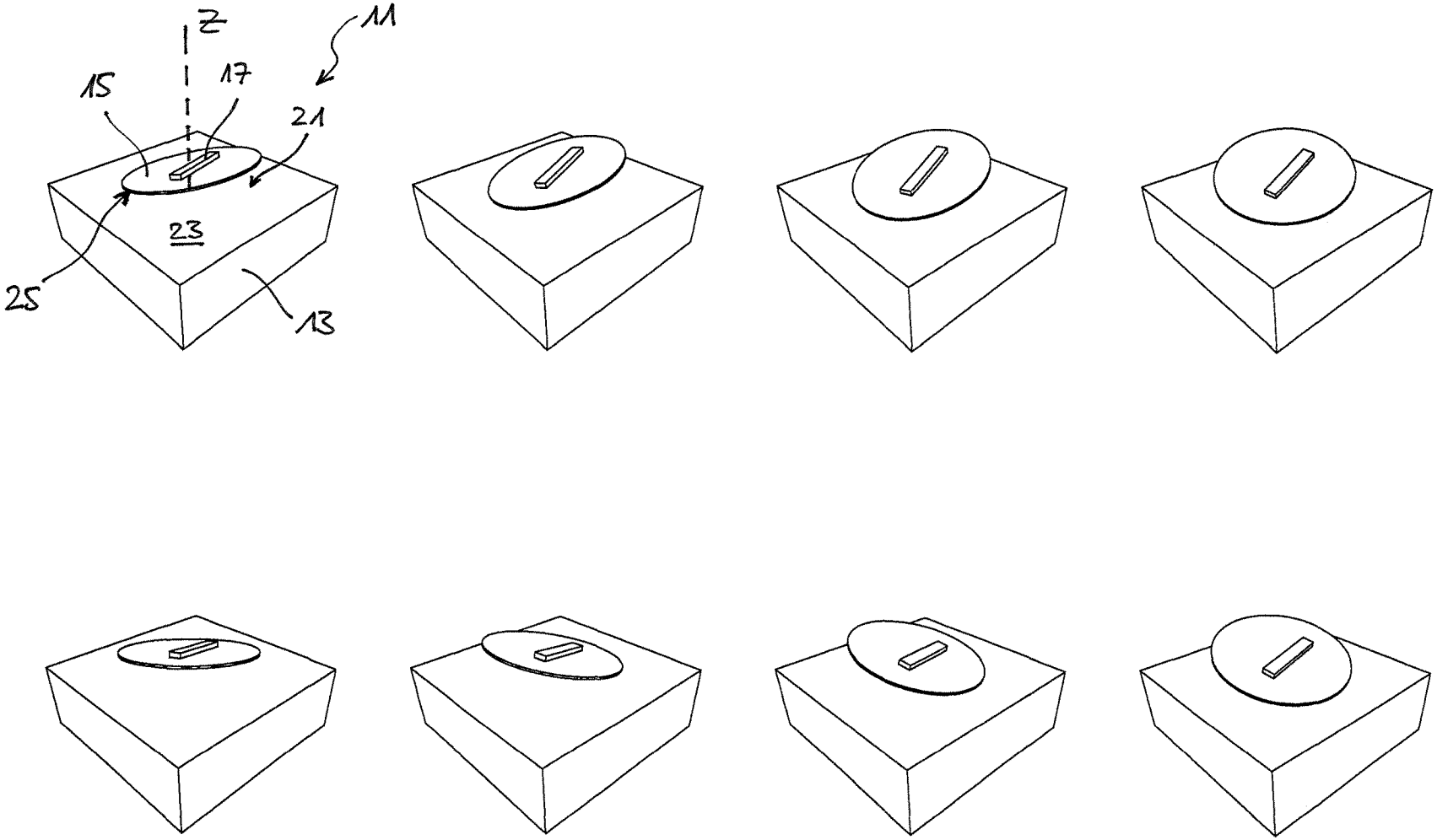
FIG. 1 shows in a simplified schematic representation an embodiment of a laboratory device in accordance with the invention at eight points in time consecutive in time during a tumbling movement.

The laboratory device 11 shown in FIG. 1 is shown schematically in a highly simplified manner and comprises a base unit 13, that is shown as a parallelepiped, and a pivot unit 15, that is shown as a circular disk. A sample 17 is arranged on the pivot unit 15 to illustrate the spatial orientation of the pivot unit 15; said sample is shown as an elongate block that is intended to embody a container having a substance to be mixed. The pivot unit 15 is connected to the base unit 13 via a bearing element 19 (cf. FIGS. 2 to 4) covered by the pivot unit 15 and is pivotable about axes perpendicular to a central axis Z of the base unit 13, but not about the central axis Z. A margin of the pivot unit 15 impacts a roll-off surface 21 that is formed at an upper wall element 23 of the base unit 13 by a pivoting. The margin of the pivot unit 15 forms a roll-off section 25 of the pivot unit 15.

The individual illustrations of FIG. 1 show eight points in time following one another uniformly within a single revolution of a tumbling movement of the pivot unit 15. In this respect, the states shown in the individual representations are periodically run through counter-clockwise. In the different individual representations of FIG. 1, the pivot unit 15 is pivoted in a respective different radial direction with respect to the central axis Z, but with the rotational position of the pivot unit 15 relative to the central axis Z always being the same. This can in particular be recognized by the fact that the sample 17 continuously maintains its radial orientation with respect to the central axis Z. The pivot unit 15 therefore does not carry out any rotational movement.

As can be recognized from the illustrations, the point at which the pivot unit 15 is in contact with the base unit 13 changes continuously during the tumbling movement. The roll-off section 25 of the pivot unit 15 to this extent rolls off at the roll-of surface 21 of the base unit 13.

Figure 2:
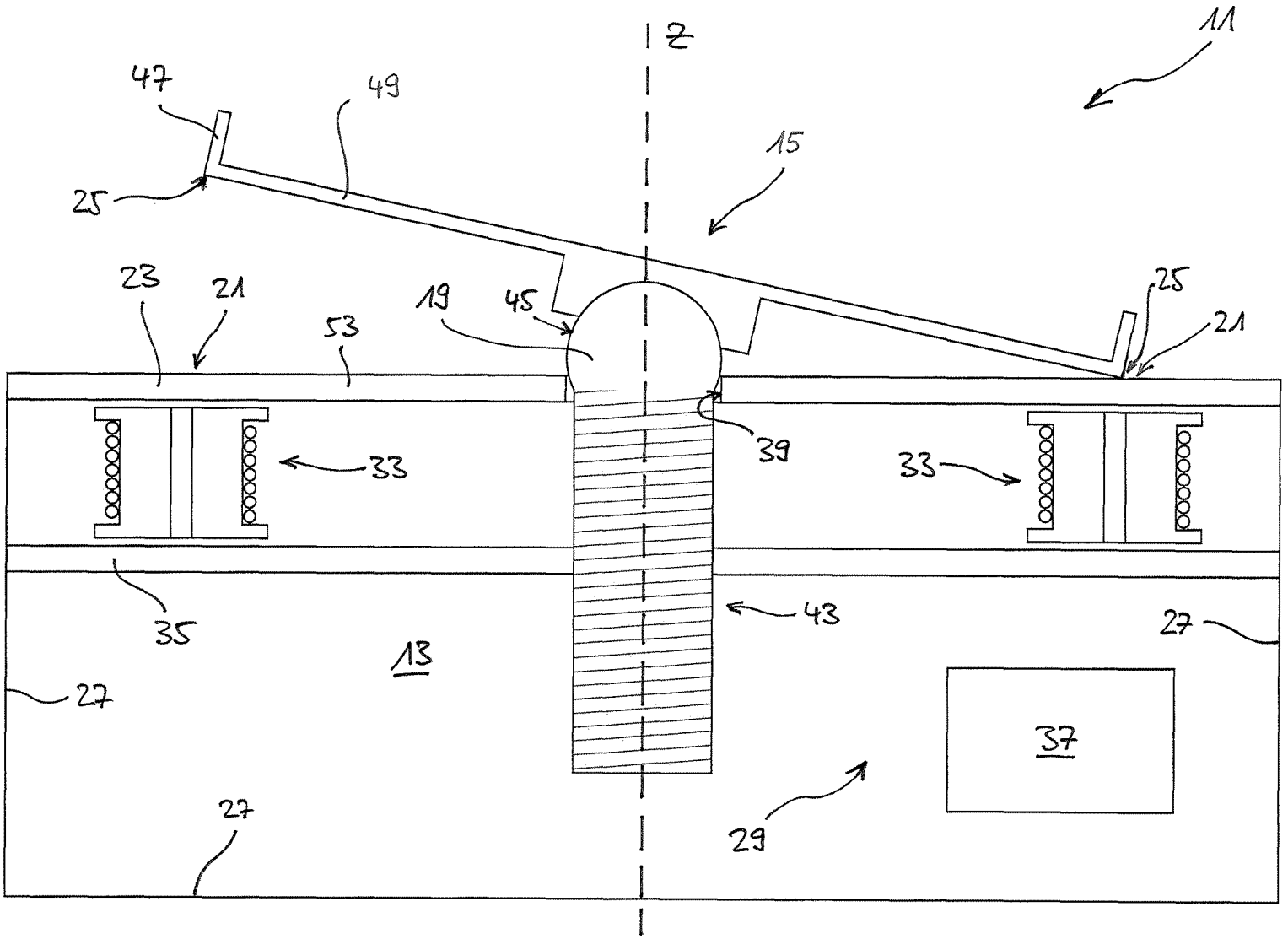
FIG. 2 shows a first embodiment of a laboratory device in accordance with the invention in a schematic cross-section.

The laboratory device 11 shown in FIG. 2 is shown in cross-section. A base unit 13 of the laboratory device 11 here has a wall element 23 as an upper boundary. The base unit 13 is bounded by further housing walls 27 toward the other sides. The base unit 13 comprises a drive apparatus 29 in its interior that has an arrangement of magnetic elements 33 that are formed as controllable electromagnets in the form of magnetic coils and that are spatially fixedly arranged in the base unit 13. Overall, the arrangement comprises six magnetic elements 33 that are uniformly arranged along a circular path about the central axis Z and of which only those two are shown that are located in the sectional plane of the illustration. In addition, the drive apparatus 29 has a control apparatus 37 that can control the magnetic elements 33 to generate respective magnetic fields and is only shown schematically.

A bearing element 19 is received in a receiver 39 formed in the wall element 23. The bearing element 19 is substantially cylindrical and has a threaded section 43 that can cooperate with an internal thread (not shown) of the receiver 39 to variably define the position of the bearing element 19 axially to the central axis Z. At the end facing away from the base unit 13, the bearing element 19 has a spherical head 45 at which a pivot unit 15 is pivotably supported. A plate 35 is arranged beneath the magnetic elements 33 to provide, together with the bearing element 19 and the pivot unit 15, a magnetic ring closure for the magnetic field generated by the respective magnetic element 33. The remaining base unit 13 is furthermore shielded with respect to the magnetic fields generates by the magnetic elements 33 by the plate 35.

The pivot unit 15 is substantially configured as a circular disk having a peripheral web section 47 that extends away from the base unit 13 and that serves for the securing of samples (not shown) arranged at the upper side of the pivot unit 15. The circular disk and the web section 47 to this extent form a reception section 49 of the pivot unit 15.

The pivot unit 15 is preferably formed as ferromagnetic at least at its lower side facing the base unit 13 and/or at least along the margin facing away from the central axis Z. The lower outer edge of the pivot unit 15 facing the base unit 13 thus forms a roll-off section 25 of the pivot unit 15.

In the state of the laboratory device 11 shown in FIG. 2, the magnetic element 33 shown at the right is controlled by the control apparatus 37 to generate a magnetic field that passes through the wall element 33 and thus is also presents in a sufficient intensity at the outer side of the wall element 23 oriented toward the pivot unit 15 to be able to magnetically attract the roll-off section 25 of the pivot unit 15 toward the roll-off surface 21 at the wall element 23. The remaining magnetic elements 33 are not controlled to generate a magnetic field at this point in time. The magnetic field has the greatest effect on that region of the roll-off section 25 that is located closest to the magnetic element 33. The pivot unit 15 is therefore pivoted in the direction of this magnetic element 33 so that the roll-off section 25, as shown, contacts a point of said region at the roll-off surface 21.

The control apparatus 37 is configured to control the magnetic elements 33 to generate a magnetic field that runs around at the upper side of the wall element 23. For this purpose, the magnetic field of the magnetic element 33 shown at the right in FIG. 2 is attenuated, whereas the magnetic field of the magnetic element 33 (not shown) following along the circular arrangement of the magnetic elements 33 is simultaneously amplified until the magnetic field has so-to-say migrated onward to this following magnetic element 33. The attenuation of the one field and the amplification of the other field preferably take place such that the current of the one coil is reduced in a sinusoidal form, whereas the current of the other coil is increased in cosine form with the same prefactor and the same argument so that, in accordance with the Pythagorean trigonometric identity, the total force with which the two coils attract the pivot unit 15 remains constant. This routine can be continuously repeated with the respective following magnetic elements 33, whereby the magnetic field at the outer side of the wall element 23 runs around along a closed path that substantially corresponds to the circular arrangement of the magnetic elements beneath the wall element 23 and is therefore itself circular.

The region of greatest magnetic attraction at the roll-off section 25 of the pivot unit 15 also runs around continuously due to the peripheral magnetic field. The pivot unit 15 is therefore pivoted in a peripheral radial direction continuously changing, that is running around the central axis Z, so that the pivot unit 15 carries out a tumbling movement. The roll-of section 25 of the pivot unit 15 here continuously rolls off at the roll-off surface 21 formed at the upper side of the wall element 23.

Due to the geometry of the wall element 23 and of the pivot unit 15 and due to the spacing of the pivot point defined by the center of the spherical head 45 of the bearing element 19 from the wall element 23 and from the pivot unit 15, the angle of inclination of the pivot unit relative to the central axis Z is fixed during the tumbling movement. Since the bearing element 19, however—due to the cooperation of the threaded section 43 with the internal thread (not shown) of the receiver 39—is fixable at different axial positions with respect to the central axis, the angle of inclination of the tumbling movement can be changed. A greater inclination, for example, results when the bearing element 19 is unscrewed further from the base unit 13 in comparison with the position shown in FIG. 2 since the pivot unit 15 then has to be pivoted more until the roll-off section 25 reaches the roll-off surface 21.

To achieve a particularly uniform tumbling movement and to achieve a magnetic attraction that is at least approximately constant (albeit peripheral) in amount with a circularly peripheral magnetic field, it is favorable if the roll-off section 25 is in turn configured as circular, as in the embodiment shown in FIG. 2, for instance. If the roll-off section 25 is arranged directly at the reception section 49, the reception section 49 has to be suitably configured for the tumbling movement to be achieved, that is, for instance, it must have a circular periphery as in the pivot unit shown in FIG. 2 and substantially formed as a circular disk.

Figure 3:
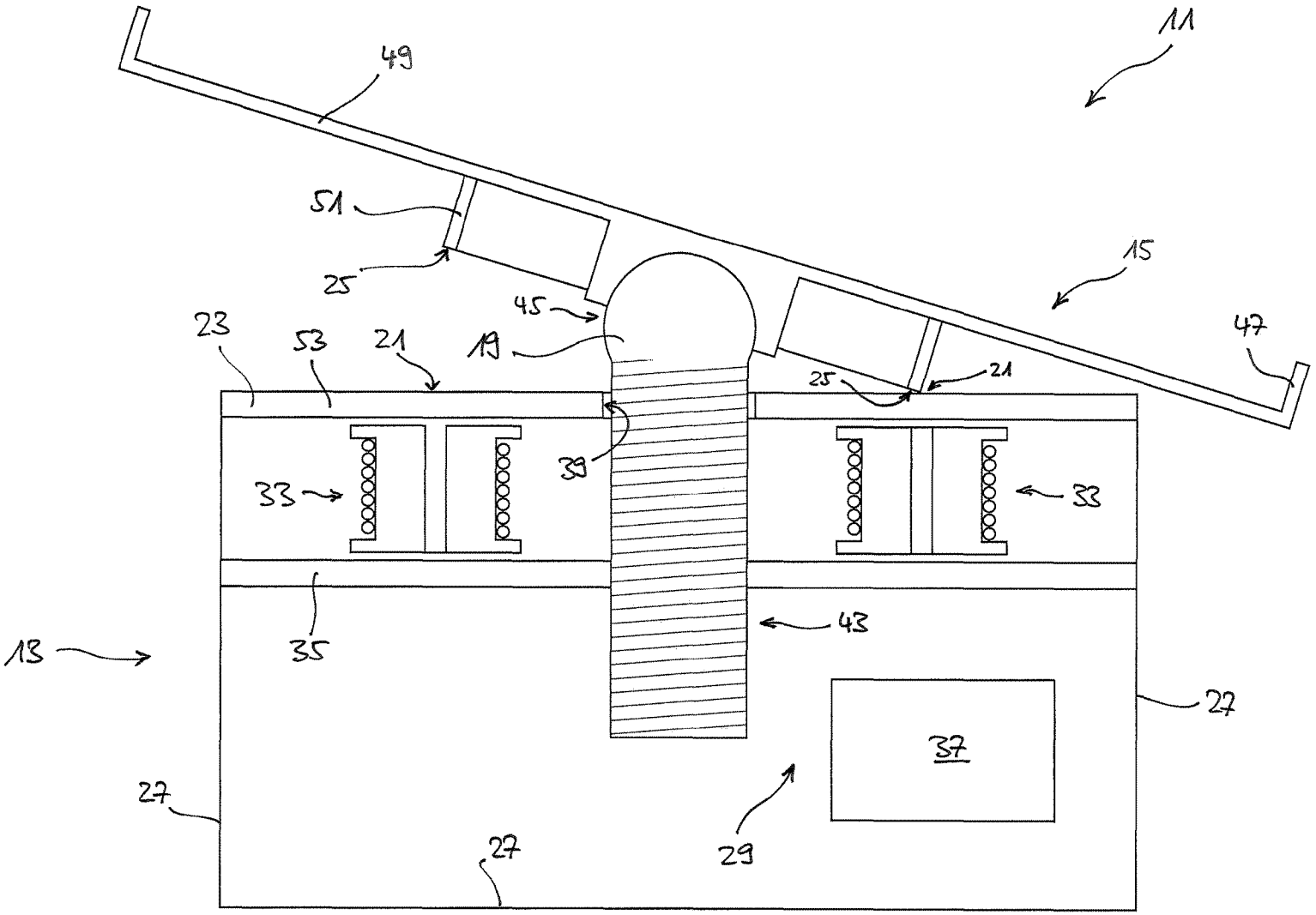
FIG. 3 shows a second embodiment of a laboratory device in accordance with the invention in a schematic cross-section.

However, to be able to form the reception section 49 independently of the tumbling movement, a base portion 51 that comprises the roll-off section 25 can be formed at the pivot unit 15 as in the embodiment shown in FIG. 3. The base portion 51 can then be configured with respect to the tumbling movement to be achieved, while the reception section 49 can be configured independently thereof only with respect to the reliable reception of samples. The reception section 49 can therefore, for instance, also be formed as a rectangular plate such as is the case in the embodiment shown in FIG. 3 that otherwise substantially corresponds to the embodiment shown in FIG. 2, with the same reference numerals marking mutually corresponding elements.

The base portion 51 is substantially formed as a hollow cylinder that can be arranged at the lower side of the reception section 49 of the pivot unit 15 around the bearing element 19. The base portion 51 can generally be formed in one part with the reception section 49. In the embodiment shown, the base portion 51 and the reception section 49 are, however, formed separately. The base portion 51 is in particular releasably connected to the reception section 49 so that it can be selectively used or replaced with another base portion (not shown). In this respect, the respective base portion 51 is selected such that the base portion 51 impacts the wall element 23 on a pivoting of the pivot unit 15 so that the roll-off section 25 formed at the base portion 51 can cooperate with the roll-off surface 21. As the embodiment shown in FIG. 3 illustrates, the use of such a base portion 51 also permits great inclinations with reception sections 49 whose dimensions exceed those of the base unit 13.

Figure 4:
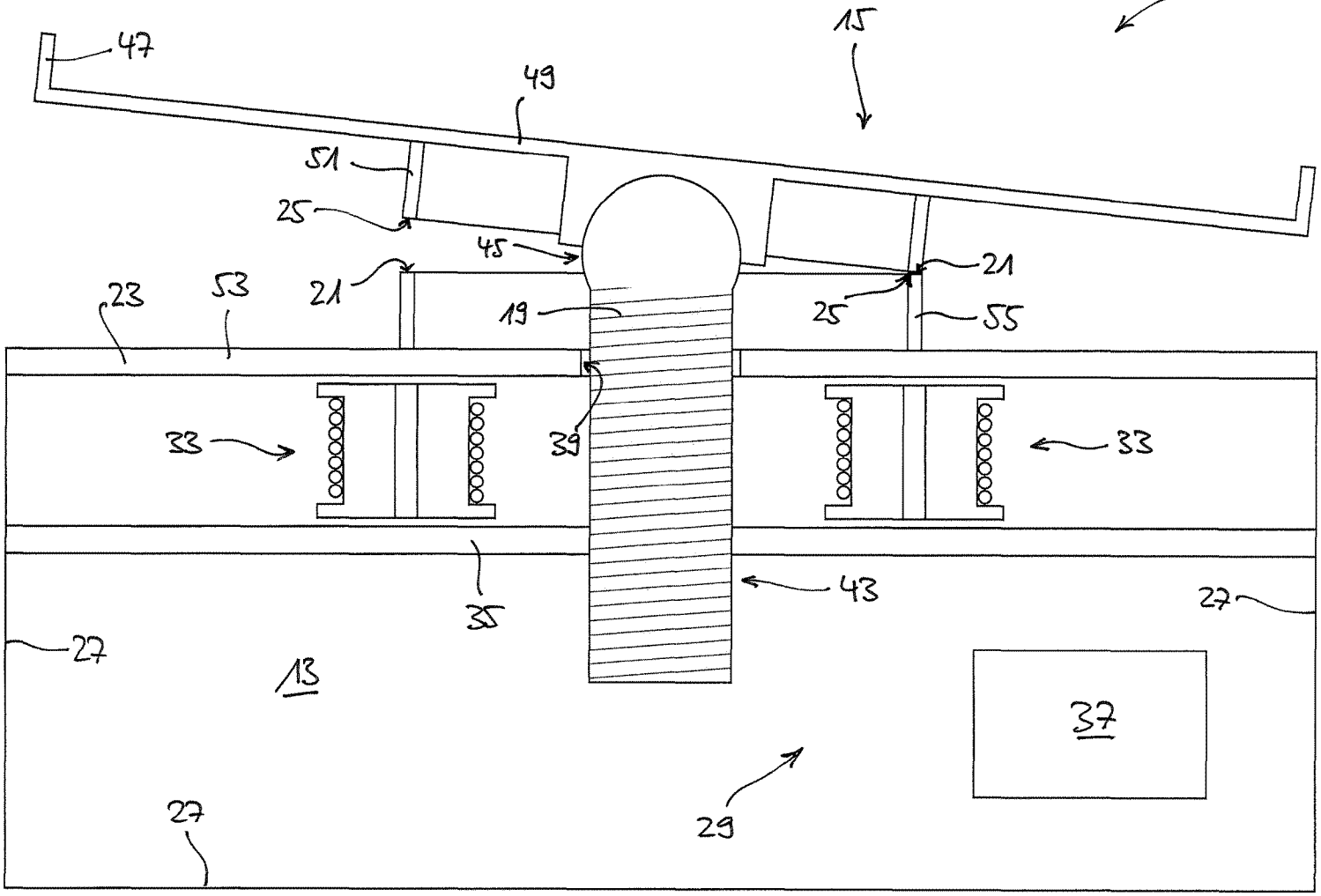
FIG. 4 shows a third embodiment of a laboratory device in accordance with the invention in a schematic cross-section.

A further embodiment is shown in FIG. 4 that largely corresponds to the embodiments of the laboratory device 11 shown in FIGS. 2 and 3, with the same reference numerals marking mutually corresponding elements. In the laboratory device 11 in FIG. 4, however, unlike the other embodiments, an attachment element 55 is additionally provided at the wall element 23 of the base unit 13 formed as a plate 53. The attachment element 55 can also be provided when no roll-off element 51 is provided.

In general, the attachment element 55 can be formed as part of the wall element 23 and in particular in one part with the plate 53. In the embodiment shown, the attachment element is formed, however, in a similar manner to the above-named base portion 51, as a separate hollow cylinder and can be placed onto the plate 53 to provide a roll-off surface 21 projecting in the direction toward the pivot unit 15 with respect to the plate 53 for the rolling off of the roll-off section 25 of the pivot unit 15. The roll-off surface 21 can then, as shown, be formed by the front surface of the attachment element 55 that faces the pivot unit 15 and that is a circular surface in the embodiment shown.

The attachment element 55 can here be matched in size and shape to the desired tumbling movement so that the plate 53 can be formed independently thereof. In addition, the attachment element 55 is adapted to the magnetic field generated by the arrangement of the magnetic elements 33 so that the magnetic field in particular runs around along the roll-off surface 21 to a sufficiently high degree to attract the roll-off section 25 of the pivot unit 15 and thus to be able to bring about the tumbling movement of the pivot unit 15. The attachment element 55 can in particular, for instance, be formed with respect to its material and/or its shape such that is promotes the formation of the magnetic field along the roll-off surface 21.

Like the base portion 51 at the remaining pivot unit 15, the attachment element 55 is arranged releasably and replaceably at the remaining base unit 13. The embodiment shown in FIG. 4 can therefore selectively also be operated without an attachment element 55 or without a base portion 51 to generate any respective tumbling movements. If no attachment element 55 or no base portion 51 is present, the (effective) roll-off surface 21 or the (effective) roll-section 25 is formed directly at the wall element 23 or at the reception section 49. The position of the respective currently effective roll-off surface 21 or of the respective currently effective roll-off section 25 can consequently be changed by replacing or removing the respective attachment element 55 or of the respective base portion 51

With the laboratory devices 11 shown in FIGS. 2 to 4, the bearing element 19 cannot only be changed in its axial position, but can rather also be removed from the receiver 39 or can be replaced with another bearing element (not shown). It is, on the one hand, possible in this manner to use the base unit 13 in isolation as a magnetic stirrer in that a stirring vessel having a magnetic stir bar is placed onto the wall element 23 that is then driven to make a stirring movement by the drive apparatus 29. For this purpose, a plug (not shown) can be provided for a flush closing of the receiver 39. It is, on the other hand, possible to replace the pivot unit 15 with another work unit (not shown) which is optionally to be supported in another manner at the base unit 13 and which can be driven selectively alternatively to the pivot unit 15 by the drive apparatus 29 in a magnetic manner to make a working movement. A work unit can, for example, be provided for generating a rocking movement. Furthermore, for instance, the embodiments shown in the Figures can also be driven to make a rocking movement in that e.g.

the shown respective work unit 15 is only alternately pivoted in the radial direction shown and in the radial direction opposite thereto. The two magnetic elements 33 shown in the sectional representations can then also be sufficient to drive such a rocking movement.

The described laboratory devices 11 therefore have a particularly high flexibility with respect to their possible use with a configuration simple in construction.

REFERENCE NUMERAL LIST

11 laboratory device
13 base unit
15 pivot unit
17 sample
19 bearing element
21 roll-off surface
23 wall element
25 roll-off section
27 housing wall
29 drive apparatus
33 magnetic element
35 return plate
37 control apparatus
39 receiver
43 threaded section
45 spherical head
47 web section
49 reception section
51 base portion
53 plate
55 attachment plate
Z central axis

The invention claimed is:

1. A laboratory device, comprising:

a base unit and a pivot unit that is pivotably connected to the base unit by means of a bearing element about axes oriented perpendicular to a central axis of the base unit, wherein the base unit comprises a drive apparatus to drive the pivot unit to make a tumbling movement about the central axis, wherein the drive apparatus comprises an arrangement of magnetic elements at an inner side of a roll-off surface of the base unit and a control apparatus; and wherein the pivot unit has a peripheral roll-off section, with the control apparatus being configured to control the arrangement of magnetic elements for generating a magnetic field running around along a closed path at an outer side of the roll-of surface to drive the roll-off section of the pivot unit by at least one of magnetically attracting and magnetically repulsing the roll-off section of the pivot unit to make the roll-off section of the pivot unit roll off along said path at the outer side of the roll-off surface of the base unit.

2. The laboratory device of claim 1, wherein the laboratory device is configured to shake and/or mix substances.

3. The laboratory device of claim 1, wherein the pivot unit is blocked against a rotation about the central axis.

4. The laboratory device of claim 3, wherein the pivot unit is blocked by the bearing element against a rotation about the central axis.

5. The laboratory device of claim 1, wherein the magnetic elements are controllable electromagnets.

6. The laboratory device of claim 1, wherein the arrangement of magnetic elements comprises at least three magnetic elements.

7. The laboratory device of claim 6, wherein the at least three magnetic elements are arranged along a circular path and/or equidistantly from one another.

8. The laboratory device of claim 6, wherein the arrangement of magnetic elements comprises at least four and at most eight magnetic elements.

9. The laboratory device of claim 1, wherein the roll-off section is circular.

10. The laboratory device of claim 1, wherein the control apparatus is configured to control the arrangement of magnetic elements for generating a uniformly peripheral magnetic field.

11. The laboratory device of claim 1, wherein the control apparatus is configured to control microsteps.

12. The laboratory device of claim 1, wherein the base unit is bounded in the direction toward the pivot unit by a wall element at which an attachment element is arranged that projects in the direction toward the pivot unit with respect to the wall element; and wherein the roll-off surface is formed at the attachment element.

13. The laboratory device of claim 1, wherein the pivot element comprises a reception section configured to receive substances and a base portion; and wherein the base portion projects in the direction toward the base unit with respect to the reception section and comprises the roll-off section.

14. The laboratory device of claim 1, wherein the laboratory device is configured such that a spacing of the pivot unit from the base unit can be variably fixed.

15. The laboratory device of claim 1, wherein the roll-off surface of at least one of the base unit and the roll-off section of the pivot unit is configured as at least one of changeable and replaceable.

* * * * *